US005487279A

United States Patent [19]

Eybergen et al.

[11] Patent Number: 5,487,279

[45] Date of Patent: Jan. 30, 1996

[54] HEAT EXCHANGER WITH INTEGRAL FILTER/DRIER CARTRIDGE

[75] Inventors: William N. Eybergen, Dutton; Wayne K. Hutchison, Ingersoll, both of Canada

[73] Assignee: Eaton Corporation, Cleveland, Ohio

[21] Appl. No.: 315,044

[22] Filed: Sep. 29, 1994

[51] Int. Cl.[6] ..... F25B 43/00

[52] U.S. Cl. ..... 62/474; 165/134.1

[58] Field of Search ..... 62/474, 507; 165/119, 165/134.1

[56] References Cited

U.S. PATENT DOCUMENTS

| | | | |
|---|---|---|---|
| 2,260,608 | 10/1941 | Cormack | 62/474 X |
| 2,645,099 | 7/1953 | Cumming | 62/474 X |
| 2,658,359 | 11/1953 | Money | 62/474 |
| 3,149,479 | 9/1964 | Peterson | 62/474 |
| 4,637,881 | 1/1987 | Sciuto | 62/474 X |
| 5,146,767 | 9/1992 | Kadle et al. | 62/474 |

*Primary Examiner*—William E. Tapolcai
*Attorney, Agent, or Firm*—Roger A. Johnston

[57] ABSTRACT

A heat exchanger or condenser for a refrigerant system having an inlet tubular heat exchange surface and an enlarged tubular outlet. A cartridge type filter/drier has a shell or canister containing desiccant secured to a header with an outlet. In one embodiment the header is welded in the condenser enlarged outlet; and, in another embodiment the header is sealed in the enlarged outlet by an o-ring and retained by deforming the outlet tube over the header.

12 Claims, 2 Drawing Sheets

HEAT EXCHANGER WITH INTEGRAL FILTER/DRIER CARTRIDGE

BACKGROUND OF THE INVENTION

The present invention relates to exothermic heat exchangers and particularly heat exchangers of the type employed for cooling of compressed refrigerant gas discharged from a compressor, which are often referred to as condensers due to the change of state of the refrigerant from a gas to a liquid during cooling. In providing condensers for refrigerant gasses and the associated conduits for connection to the other components of the refrigerant system, it has heretofore been the practice to incorporate a filter/drier in the system conduits on the discharge or downstream side of the condenser.

In refrigerant systems employed for vehicle passenger compartment air conditioning systems, it has been common practice to mount a drier/filter on the vehicle body at a location generally adjacent the condenser such that the conduit connections from the drier/filter to the expander for the evaporator intake are maximized to continue the cooling function of the condenser. This arrangement permits any condensed refrigerant gas discharging from the condenser to be further cooled by the filter/drier and the conduits leading to and from the filter/drier thereby ensuring that only high pressure liquid refrigerant enters the expander.

In vehicle air conditioning systems, the competitive nature of the marketplace dictates that the cost of the air conditioning refrigerant system be minimized. Accordingly it has been desired to reduce the number of conduit connections and fittings required for a vehicle air conditioning system and particularly those of the type employed in mass produced passenger automotive vehicles. It has thus been desired to provide a way or means of incorporating a filter/drier into an automotive air conditioning system with a minimum of conduit fittings and connections.

SUMMARY OF THE INVENTION

It is an object of the present invention to provide an exothermic heat exchanger having an integral filter/drier incorporated in the construction thereof.

It is a further object of the present invention to provide the condenser for circulating refrigerant and to incorporate a filter/drier in the construction of the condenser.

It is a further object of the present invention to incorporate a filter/drier cartridge into the outlet of a refrigerant condenser.

It is a further object of the present invention to provide a filter/drier cartridge which is assembleable into the outlet of a refrigerant condenser integrally during the manufacture of the condenser.

The present invention provides an exothermic heat exchanger having a tubular conduit with an inlet and an enlarged outlet portion formed in the end of the conduit remote from the inlet with a preassembled filter/drier cartridge received in the enlarged outlet portion. The cartridge has a basket having the rim of the open end attached to a header with an outlet port formed therein. The basket contains desiccant material and is perforated in the end remote from the header such that upon assembly of the cartridge into the enlarged outlet portion of the condenser refrigerant flows into the perforated end of the basket and through the desiccant to the header outlet. In one embodiment the header is sealed in the condenser outlet by a resilient seal ring and the enlarged outlet of the condenser is deformed over the header to retain it in position. In another embodiment the header is peripherally welded about the enlarged end of the condenser after assembly of the cartridge therein.

DETAILED DESCRIPTION

Figure 1:
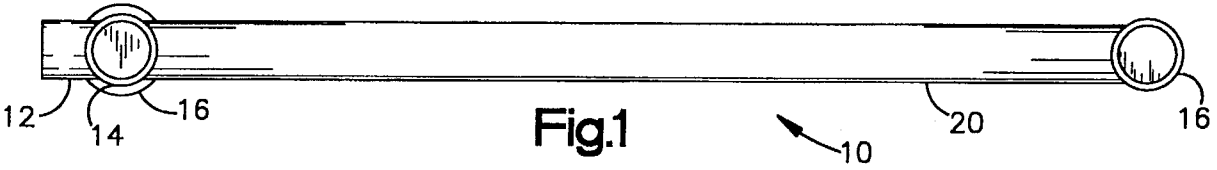
FIG. 1 is a top or plane view of an exothermic heat exchanger according to the present invention.
Figure 2:
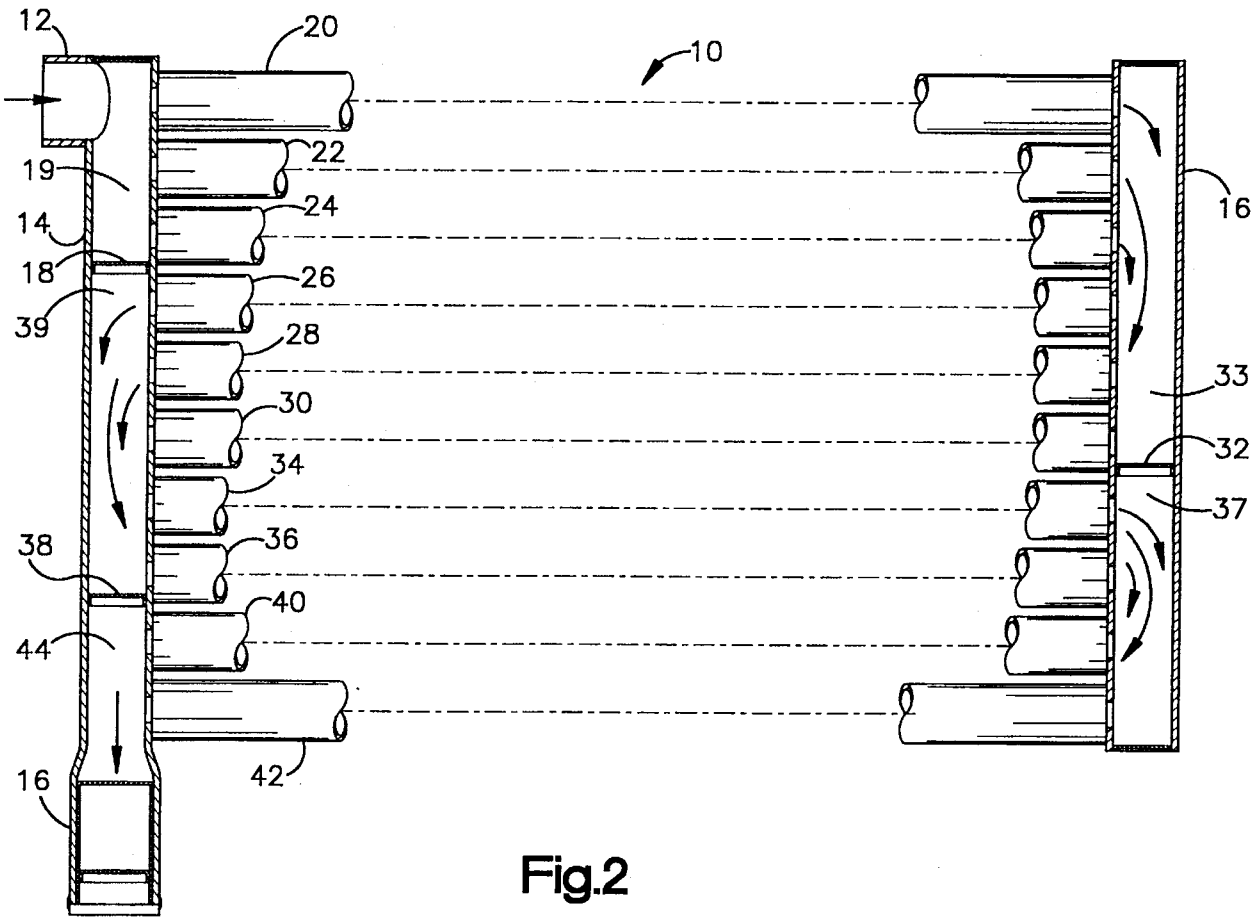
FIG. 2 is a side elevation view of the heat exchanger of FIG. 1.

Referring to FIGS. 1 and 2, the heat exchanger assembly is indicated generally at 10 and has an inlet to adapt it for external connection thereto denoted by reference numeral 12 for receiving a flow of pressurized fluid such as refrigerant therein. In the presently preferred practice, the inlet 12 is connected to one end of a manifold tube 14 which has at the remote end thereof an enlarged portion denoted by reference numeral 16. A second manifold tube 16 is disposed in spaced generally parallel arrangement with the manifold 14; and, the manifolds 14 and 16 are interconnected as will hereinafter be described by a plurality of cross tubes.

It will be understood that the heat exchanger construction illustrated in the drawings is arranged in the preferred manner for an application in an automotive air conditioning system; however, other arrangements may be employed as, for example, a continuous tube having a serpentine or sinusoidal configuration between the inlet 12 and outlet 16.

Referring to FIGS. 1 and 2, the first manifold 14 has a plug or partition 18 disposed therein at a desired distance from the inlet 12 such that a common end of a plurality of cross tubes denoted by reference numerals 20, 22, 24 are in communication with a chamber 19 and the inlet 12; and, the opposite end of the tubes 20, 22, 24 are connected to the upper end of manifold 16. A second plurality of manifold tubes denoted by reference numerals 26, 28, 30 have one common end of each connected to the manifold 16 with the opposite end of each tube 26, 28, 30 connected to chamber 39 in manifold 14 on the side of plug 18 opposite the tubes 20, 22, 24. A second partition or plug 32 is provided in the manifold 16 to isolate to form a common chamber 33 in the manifold communicating with the tubes 20–30. A third plug or partition denoted by reference numeral 38 is provided in manifold 14 to form the chamber 39.

It will be understood that flow entering inlet 12 flows into chamber 19 and through tubes 20, 22, 24 into the chamber 33 in manifold 16 and returns to chamber 39 in manifold 14 through tubes 26, 28, 30. An additional plurality of tubes denoted by reference numerals 34, 36 each have a common end thereof attached to chamber 39 in manifold 14 with the opposite end of each attached to manifold 16 to communicate with the chamber 37 formed below plug 32.

Thus flow returning from tubes 26, 28, 30 in chamber 39 flows through tubes 34, 36 into the chamber 37 in manifold 16.

A plurality of tubes denoted by reference numerals 40, 42 has one common end of each connected to manifold 14 below plug 38 to communicate with the outlet chamber 44, with the opposite end of the tubes 40, 42 connected to manifold 16 to communicate with the chamber 37. Thus flow entering chamber 37 from tubes 34, 36 returns to manifold 14 in chamber 44 via tubes 40, 42 and from chamber 44 flows to the outlet 16.

Figure 3:
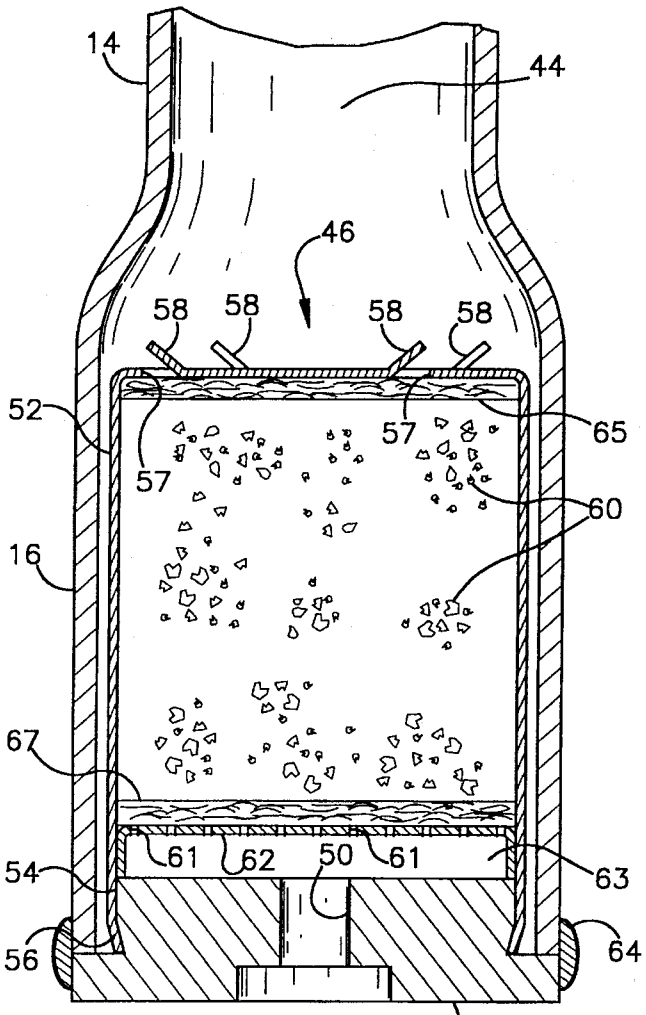
FIG. 3 is an enlarged view of a portion of the outlet of the heat exchanger of FIG. 2; and, FIG. 4 is a view similar to FIG. 3 of another embodiment of the invention.

Referring to FIG. 3, the enlarged end portion 16 of the manifold 14 has received therein a filter/drier cartridge indicated generally at 46 which is formed of a header 48 having an outlet passage 50 formed therein with a basket or shell 52 having the rim of the open end thereof attached to the header 50. In the presently preferred practice the header 50 has a reduced diameter portion 54 which is undercut at 56 such that the end of the basket 52 is deformed such as by crimping thereover and is thus retained thereon. The end of the basket 52 remote from header 48 is perforated to form apertures 57 preferably by punching out tabs as denoted by reference numeral 58.

The basket 52 is filled with a suitable desiccant material indicated by reference numeral 60 which is preferably of a granular form.

A perforated metal cup 62 having a plurality of apertures 61 is pressed into the end of the shell 52 and forms a plenum chamber 63 between the desiccant material and header outlet. In the presently preferred practice a layer of suitable filter material such as for example fibrous glass material is disposed adjacent the inner surface of the perforated end of the cup 52 and also adjacent the perforations in the cup 62 in the interior of the basket 52.

In the embodiment of FIG. 3, the header is peripherally welded to the enlarged diameter portion 16 of the manifold 14 as indicated by reference numeral 64 to seal and retain the header to the outlet portion 16 of manifold tube 14.

Figure 4:
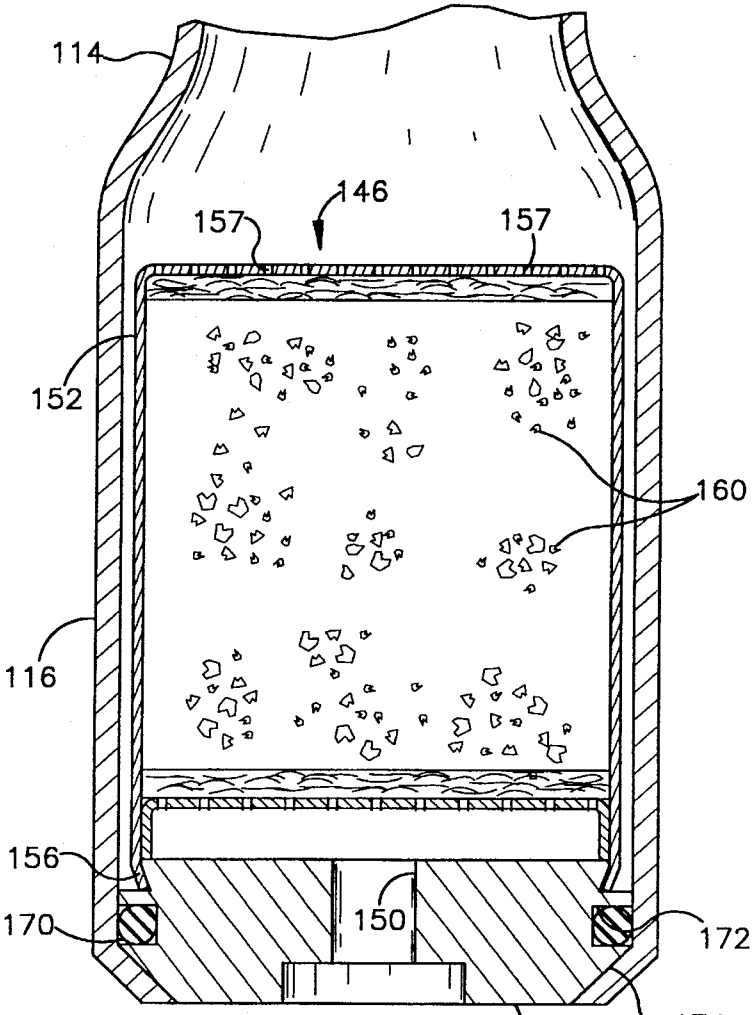

Referring to FIG. 4, an alternate embodiment of the invention is illustrated as having a tubular heat exchanger manifold 114 having an enlarged outlet end 116 with a filter/drier cartridge denoted generally at 146 received therein. The cartridge 146 has a basket or shell 152 with perforations 157 in one end and attached by the deforming the rim thereof 156 over an undercut 154 provided in a header 148 having outlet port 150. The basket is filled with desiccant material 160; and, the header 148 has a resilient seal ring received in an annular groove 172. In the embodiment of FIG. 4 the end of the enlarged tubular portion 116 of manifold 114 is deformed over a chamfered surface 174 provided on the header to retain the header and cartridge in the outlet formed by the enlarged portion 116.

The present invention thus provides a novel heat exchanger particularly suitable for the refrigerant condenser employed in automotive air conditioning applications and has a cartridge type filter/drier assembled integrally into the construction of the heat exchanger.

Although the invention has hereinabove been described with respect to the illustrated embodiments, it will be understood that the invention is capable of modification and variation and is limited only by the following claims.

We claim:

1. An exothermic heat exchanger for a refrigeration system comprising:

(a) a plurality of conduits disposed in spaced generally parallel arrangement;

(b) a first and second manifold, each disposed for interconnecting common ends of said conduits for permitting flow therebetween;

(c) a tubular outlet formed in one of said first and second manifolds;

(d) one of said first and second manifolds defining integrally therewith a cartridge receiving cavity therein; and, (e) a cartridge assembly received in said outlet, said cartridge assembly having:

(i) a header with an outlet port adapted for external conduit connection and a basket having the rim thereof attached to said header with the remote end thereof perforated;

(ii) desiccant material disposed within said basket;

(iii) sealing means operative to seal said header in said outlet.

2. The heat exchanger defined in claim 1, wherein said cartridge subassembly includes perforated plate means disposed in said basket and defining a plenum chamber between said granular desiccant material and said header outlet port.

3. The heat exchanger defined in claim 1, wherein said cartridge subassembly includes perforated plate means disposed in said basket and defining a plenum chamber between said granular filter material and said header outlet port; and, a layer of fibrous filter material disposed intermediate said granular material and said perforated plate.

4. The heat exchanger defined in claim 1, wherein said tubular outlet comprises an enlarged diameter end region of one of said manifolds.

5. The heat exchanger defined in claim 1, wherein said cartridge assembly is retained in said outlet by deformation of said tubular inlet over said header.

6. The heat exchanger defined in claim 1, wherein said cartridge assembly is retained in said outlet by weldment to said header.

7. A condenser for pressurized refrigerant flow therethrough comprising:

(a) a tubular manifold having an inlet and an enlarged end portion comprising an outlet;

(b) a plurality of tubes disposed in spaced generally parallel arrangement and each having one end communicating with said manifold;

(c) a cartridge received in said enlarged end portion; said cartridge received in said cavity and having:

(i) a header with an outlet port adapted for external conduit connection thereto;

(ii) a basket having the rim of the open end thereof attached to said header with the end remote therefrom perforated;

(iii) desiccant material disposed within said basket;

(iv) a perforated member disposed between said desiccant and defining a plenum chamber communicating with said header outlet port; and, (d) a means operative to retain and seal said header in said enlarged end portion of said manifold.

8. The condenser defined in claim 7 further including a layer of filter material adjacent said perforated material.

9. The condenser defined in claim 7 further including a layer of filter material adjacent said perforated end of said basket.

10. The condenser defined in claim 7 wherein said means operative to retain and seal comprises weldment.

11. The condenser defined in claim 7 wherein said means operative to retain and seal comprises a resilient seal ring and deformation of said enlarged end portion.

12. A condenser for flow of pressurized refrigerant therethrough comprising:

(a) tubular manifold means having an inlet end and communicating with a plurality of conduits defining heat exchange surfaces and said manifold means having an enlarged end portion defining an outlet;

(b) a cartridge received in said outlet, said cartridge having:

(i) a receptacle shell containing desiccant material and having a perforated inlet portion;

(ii) a header attached to said shell and defining an outlet;

(iii) means sealing said header in said enlarged end portion of said conduit means.

* * * * *